US011173583B2

(12) United States Patent
Ge

(10) Patent No.: US 11,173,583 B2
(45) Date of Patent: Nov. 16, 2021

(54) EXTERNAL TOOTH TYPE RATCHET SCREWDRIVER

(71) Applicant: NINGBO HONY PLASTIC TECHNOLOGY CO., LTD, Zhejiang (CN)

(72) Inventor: Wenbing Ge, Zhejiang (CN)

(73) Assignee: NINGBO HONY PLASTIC TECHNOLOGY CO., LTD, Ningbo (CN)

( * ) Notice: Subject to any disclaimer, the term of this patent is extended or adjusted under 35 U.S.C. 154(b) by 391 days.

(21) Appl. No.: 16/393,946

(22) Filed: Apr. 24, 2019

(65) Prior Publication Data

US 2020/0338697 A1 Oct. 29, 2020

(51) Int. Cl.
*B25B 15/04* (2006.01)
*B25B 23/00* (2006.01)

(52) U.S. Cl.
CPC ..... *B25B 15/04* (2013.01); *B25B 23/0007* (2013.01)

(58) Field of Classification Search
CPC .... B25B 15/04; B25B 13/463; B25B 23/0007
USPC ..... 81/60–63.2, 436–439
See application file for complete search history.

(56) References Cited

U.S. PATENT DOCUMENTS 6,925,912 B2 * 8/2005 Huang ..... B25B 13/463 192/43.2
8,544,365 B2 * 10/2013 Wang ..... B25B 13/468 81/63.1
2019/0099864 A1 * 4/2019 Tsai ..... B25B 23/0007
2019/0210199 A1 * 7/2019 Hu ..... B25B 15/04

* cited by examiner

*Primary Examiner* — Hadi Shakeri

(57) ABSTRACT

An external tooth type ratchet screwdriver includes a handle and a ratchet head, the handle is provided with a ratchet seat, a first pawl and a second pawl; the ratchet head is of a round-bar shape and passes through the center of the ratchet seat; the middle part of the outer surface of the ratchet head is provided with teeth; one end of the inner circle of the first pawl is provided with a ratchet teeth structure; the second pawl has the same structure with the first pawl; the end surface of the ratchet seat is eccentrically provided with a circle of annular groove, and one end of the annular groove is cut off, and arc-shaped barrier strips are oppositely arranged on a cutoff; installation seats are formed between the wall of the ratchet seat and the arc-shaped barrier strips; a reversing cover is clamped outside the ratchet seat.

8 Claims, 5 Drawing Sheets

EXTERNAL TOOTH TYPE RATCHET SCREWDRIVER

BACKGROUND

Technical Field

The present invention relates to a screwdriver, and more particularly relates to an external tooth type ratchet screwdriver.

Related Art

A screwdriver is used as a tool for tightening and screwing a screw, and the screwdriver for mounting and removing the screw in the prior art is generally a hand-screwing screwdriver. Since the hand is limited in turning and cannot turn in one direction all the time, when the tool is used, the hand generally turns a tool handle in a desired direction and then turns in an opposite direction to reposition the tool so as to enter a next cycle. The reverse turning of the hand is to release the tool handle and then re-hold it, so that a main shaft does not move when the handle is reversed, or after being separated from the screw, the handheld tool is re-inserted into the screw to rotate, so that the entire rotation process is inconvenient.

Therefore, the tool is provided with a one-way apparatus such as a ratchet mechanism at present to form a ratchet screwdriver. By adopting the structure, the hand of a user does not need to be separated from a screwdriver handle, and the screwdriver does not need to be separated from the screw and then reinserted into the screw to rotate. However, the ratchet screwdriver in the prior art generally adopts a ratchet one-way transmission structure, and the ratchet screwdriver can only tighten the screw in a single direction, and cannot tighten the screw in a reverse direction. In order to integrate the functions, a plurality of groups of ratchet transmission mechanisms are arranged in the ratchet screwdriver, and after the ratchet screwdriver is adjusted, the rotation of the screw in different directions can be realized.

However, the existing ratchet structure has a complicated internal structure and relatively high production cost. Moreover, the internal structure is unstable, and when a high torque is applied, a rotational disengagement situation may occur, and the reliability is low. Therefore, an external tooth type ratchet screwdriver, developed by our company, of the present invention is disclosed to reduce the problems of the prior art.

SUMMARY

The present invention aims at providing an external tooth type ratchet screwdriver to realize high torque and high reliability and to solve the problems of complicated structure and high cost, thereby solving a technical problem.

In order to solve the above technical problems, the present invention adopts a technical solution as follows: an external tooth type ratchet screwdriver includes a handle and a ratchet head acting on a bolt. The handle is provided with a ratchet seat, a first pawl and a second pawl. The ratchet head is of a round-bar shape and passes through the center of the ratchet seat. The middle part of an outer surface of the ratchet head is provided with a circle of teeth. The first pawl is of an arc strip-shaped structure, and one end of the inner circle of the first pawl is provided with a ratchet teeth structure. The second pawl has the same structure with the first pawl. The end surface of the ratchet seat is eccentrically provided with a circle of annular groove, one end of the annular groove is cut off, and arc-shaped barrier strips are oppositely arranged on a cutoff. Installation seats are formed between the wall of the ratchet seat and the arc-shaped barrier strips. The first pawl and the second pawl are oppositely mounted on each installation seat, and the ratchet teeth structure on the end is exposed outside the arc-shaped barrier strips. A reversing cover is clamped outside the ratchet seat, and an inner bottom surface of the reversing cover is provided with a paddle located between the end of the first pawl and the end of the second pawl. The reversing cover rotates to enable the paddle to act on the end of the first pawl or the end of the second pawl, so that the end of the first pawl or the end of the second pawl is engaged with the teeth of the ratchet head.

A further preferred solution of the present invention: the other end of the first pawl is provided with a protrusion connecting a spring, one end of the spring is connected with the protrusion, and the other end of the spring abuts against the cutoff of the annular groove.

A further preferred solution of the present invention: the outer side surface of each arc-shaped barrier strip is adaptive to the inner side surface structure of the first pawl, and the inner side surface of the first pawl fits the outer side surface of each arc-shaped barrier strip. A step-shaped holder is arranged in the installation seats, and the other end of the first pawl is of a corresponding stepped shape. The first pawl can move in the installation seats in a manner of fitting the arc-shaped barrier strip.

A further preferred solution of the present invention: a protruded seat is also arranged on the other end of the annular groove, that is, between the two installation seats, the protruded seat limits the position of the first pawl or the second pawl, and the paddle is located above the protruded seat and can rotate.

A further preferred solution of the present invention: the inner wall of the reversing cover is provided with a plurality of grooves, and the grooves are located opposite to the paddle. The ratchet seat is connected with a latching element through an elastic element, and the latching element acts on one of the grooves. The reversing cover rotates, so that the latching element shifts among the plurality of grooves.

A further preferred solution of the present invention: the outer surface of the ratchet seat is provided with a recess, the latching element is mounted in the recess through the elastic element, and the latching element is a steel ball.

A further preferred solution of the present invention: the head part of the handle is provided with a notch, the outer wall of the ratchet seat is provided with a raised strip, the notch is adaptive to the outer surface structure of the ratchet seat, and the ratchet seat is inserted into the notch and fixed in a circumferential and radial direction.

A further preferred solution of the present invention: a first fastener connected with the periphery of the ratchet head in a clamped way is mounted in the notch, and the ratchet cover is provided with a second fastener connected with the periphery of the ratchet head in a clamped way.

A further preferred solution of the present invention: the head part of the handle is linked to the reversing cover, the handle and the reversing cover are in contact connection with each other, and the ratchet head passes through the annular cover and inserted into the ratchet seat.

Compared with the prior art, the present invention has the advantages that the handle is provided with the ratchet seat, the first pawl and the second pawl, the ratchet head is of a round-bar shape and passes through the center of the ratchet seat, and the reversing cover is clamped outside the ratchet seat. By virtue of the ratchet seat, the first pawl, the second pawl, the reversing cover and the ratchet head, the rotation direction of the present invention is adjustable. The present invention is fewer in components, simple in overall structure and low in production cost. The middle part of the outer surface of the ratchet head is provided with a circle of teeth. The first pawl is of an arc strip-shaped structure, and one end of the inner circle of the first pawl is provided with the ratchet teeth structure. The second pawl has the same structure with the first pawl. The first pawl and the second pawl are oppositely mounted on the installation seats, and the ratchet teeth structure on the end is exposed outside the arc-shaped barrier strips. The inner bottom surface of the reversing cover is provided with the paddle located between the end of the first pawl and the end of the second pawl, and the reversing cover rotates to enable the paddle to act on the end of the first pawl or the end of the second pawl, so that the end of the first pawl or the end of the second pawl is engaged with the teeth of the ratchet head. When the first pawl acts on the ratchet head, the first pawl stops the counterclockwise rotation of the ratchet head; and when the ratchet head rotates clockwise, the first pawl can be separated from the ratchet head, and the ratchet head rotates freely. When the second pawl acts on the ratchet head, the second pawl stops the clockwise rotation of the ratchet head; and when the ratchet head rotates counterclockwise, the second pawl can be separated from the ratchet head, and the ratchet head rotates freely. The end surface of the ratchet seat is eccentrically provided with a circle of annular groove, one end of the annular groove is cut off, the arc-shaped barrier strips are oppositely disposed on the cutoff, and the installation seats are formed between the wall of the ratchet seat and the arc-shaped barrier strips. The first pawl and the second pawl move in the installation seats of the ratchet seat, so that the overall movement structure is very stable. When being stressed, the first pawl and the second pawl are more tightly clamped in an eccentric structure formed by the installation seats, the torque is increased in a wedged-block way. The present invention achieves high torque and high reliability.

BRIEF DESCRIPTION OF THE DRAWINGS

The following further describes the present invention in detail with reference to the accompanying drawings and preferred embodiments. However, a person skilled in the art shall understand that these accompanying drawings are drawn to explain the preferred embodiments, and therefore should not be construed as a limitation to the scope of the present invention. In addition, unless otherwise specified, the accompanying drawings are only intended to be illustrative of the composition or construction of the described subject matter, and may include an exaggerated display, and the accompanying drawings are not necessarily drawn to scale.

DETAILED DESCRIPTION

The following describes the present invention in details with reference to the accompanying drawings.

To make the objectives, technical solutions, and advantages of the present invention clearer and more comprehensible, the following further describes the present invention in detail with reference to the accompanying drawings and the embodiments. It should be understood that the specific embodiments herein are provided for describing the present invention and not intended to limit the present invention.

Figure 1:
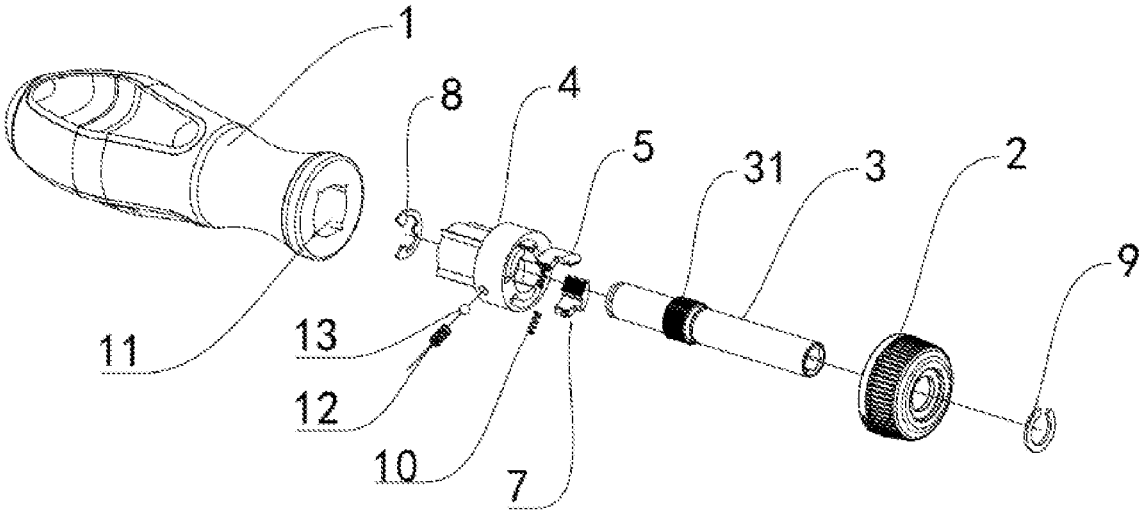
FIG. 1 is an exploded structural schematic diagram of the present invention.
Figure 2:
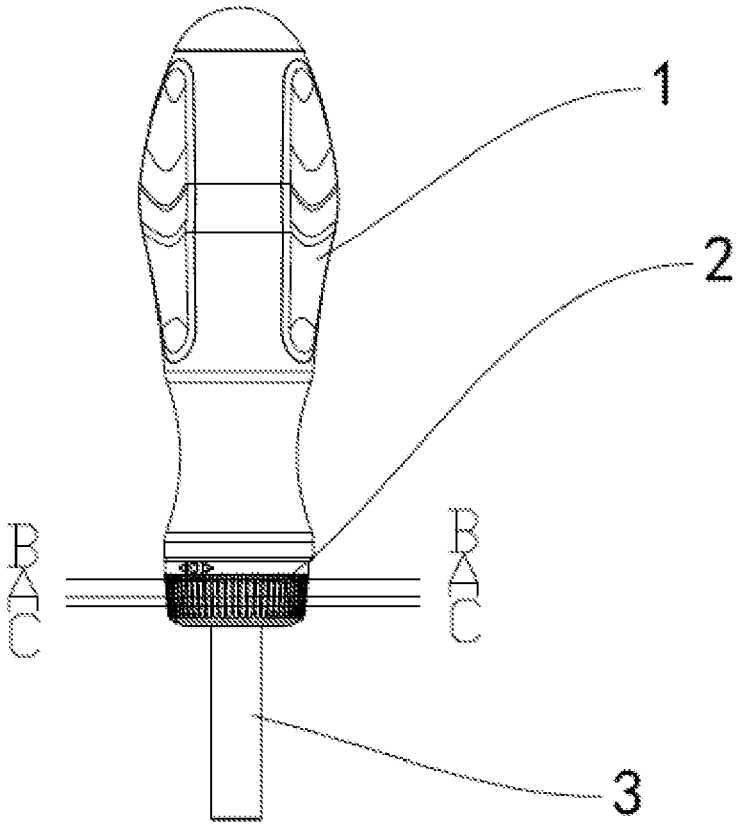
FIG. 2 is a structural schematic diagram of the present invention.
Figure 3:
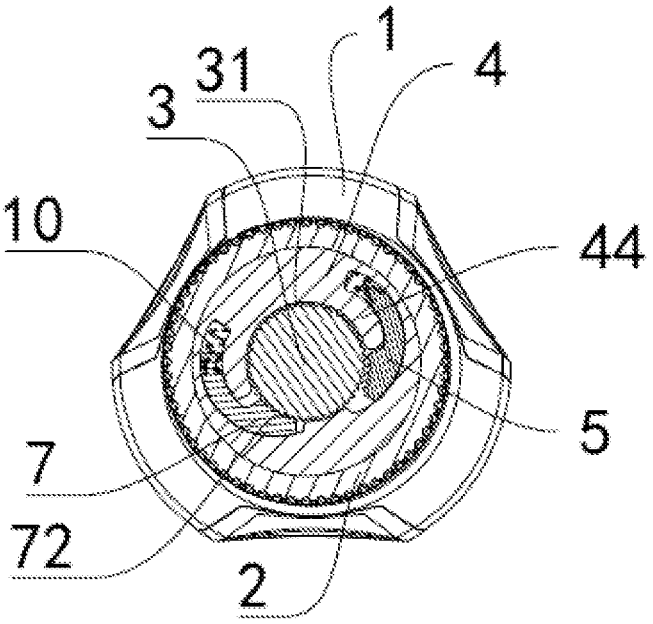
FIG. 3 is a section view of section AA in FIG. 2.
Figure 4:
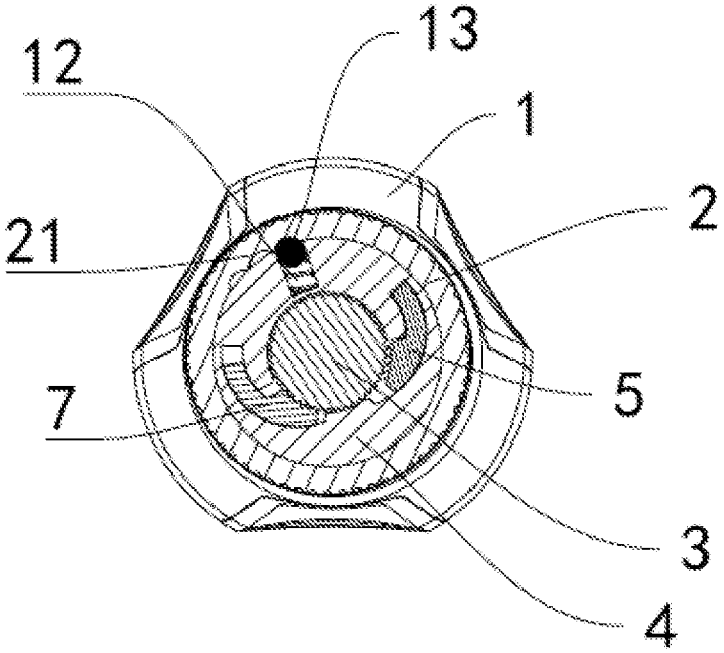
FIG. 4 is a section view of section BB in FIG. 2.
Figure 5:
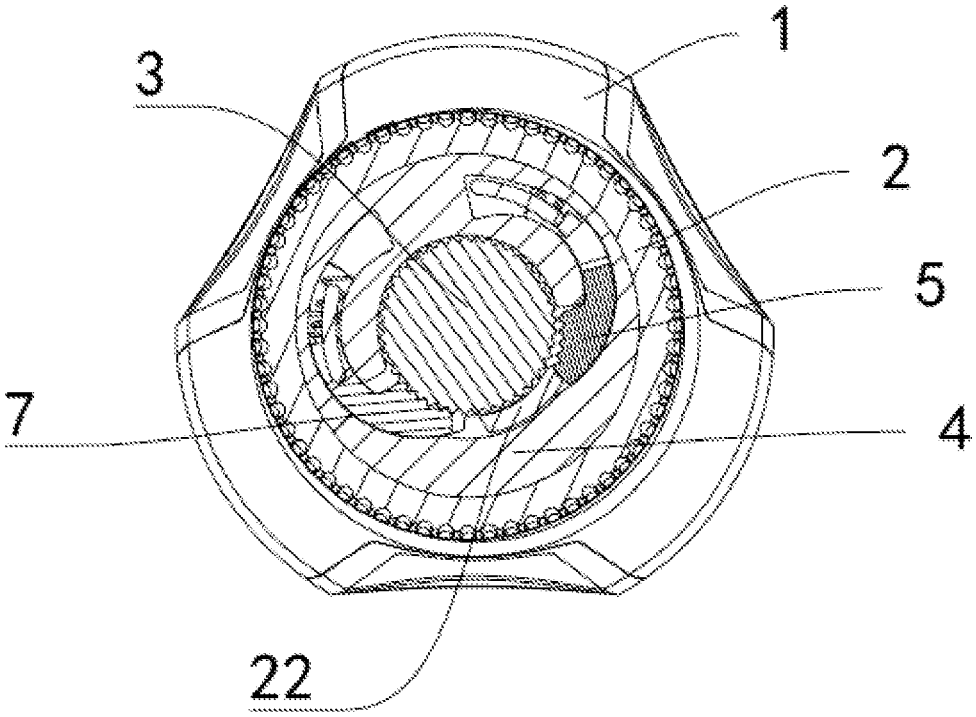
FIG. 5 is a section view of section CC in FIG. 2.
Figure 6:
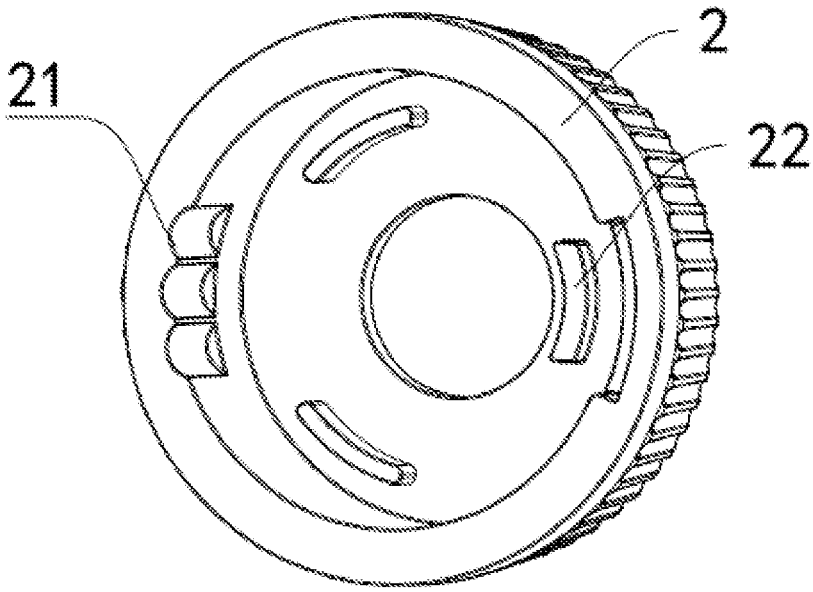
FIG. 6 is a structural schematic diagram of a reversing ring.
Figure 7:
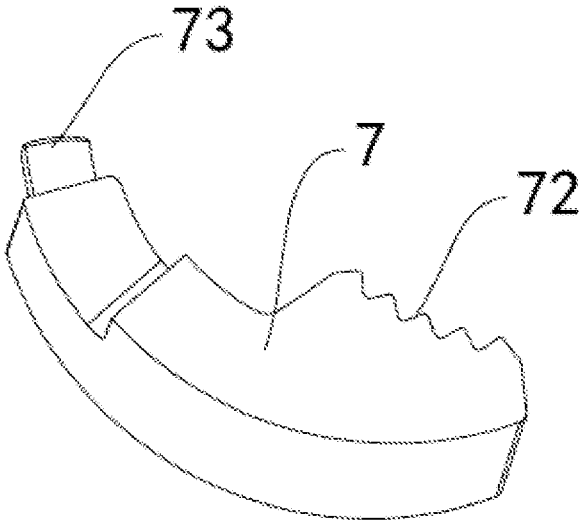
FIG. 7 is a structural schematic diagram of a first pawl.
Figure 8:
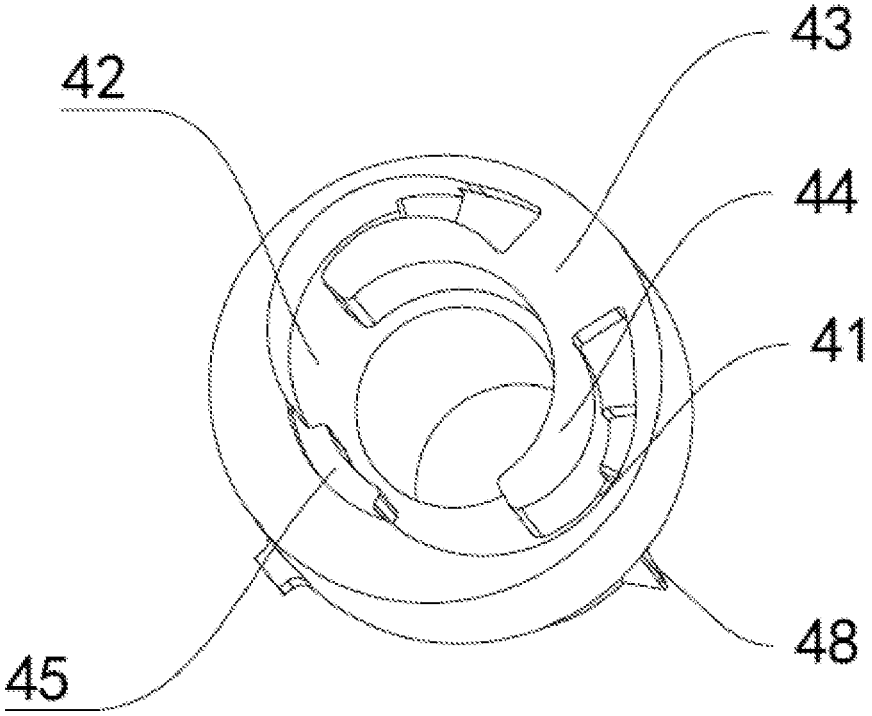
FIG. 8 is a structural schematic diagram of a ratchet seat.
Figure 9:
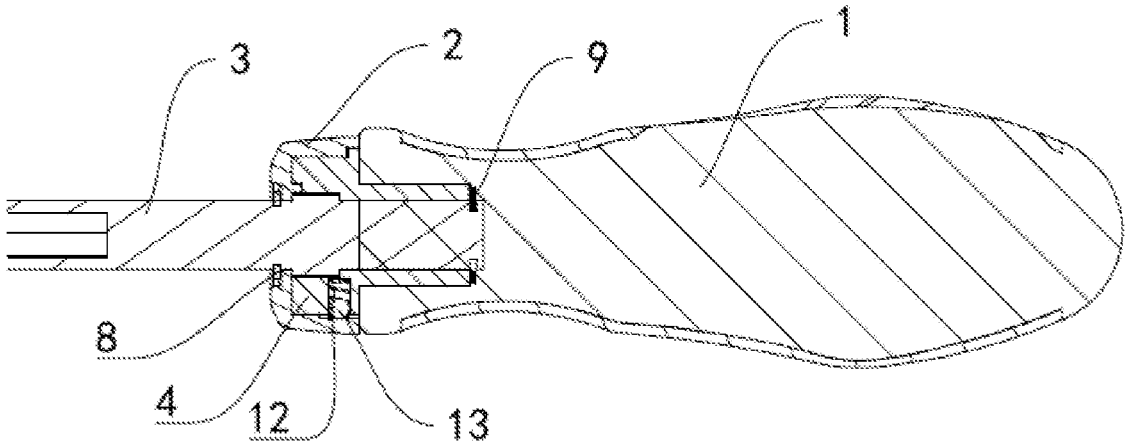
FIG. 9 is a section view of the present invention.

As shown in FIG. 1 to FIG. 9, an external tooth type ratchet screwdriver includes a handle 1 and a ratchet head 3 acting on a bolt. The handle 1 is provided with a ratchet seat 4, a first pawl 7 and a second pawl 5. The ratchet head 3 is of a round-bar shape and passes through the center of the ratchet seat 4. The middle part of the outer surface of the ratchet head 3 is provided with a circle of teeth 31. The first pawl 7 is of an arc strip-shaped structure, and one end of the inner circle of the first pawl is provided with a ratchet teeth structure 72. The second pawl 5 has the same structure with the first pawl 7. The end surface of the ratchet seat 4 is eccentrically provided with a circle of annular groove 42, one end of the annular groove 42 is cut off, and arc-shaped barrier strips 44 are arranged oppositely on the cutoff 43. Installation seats 41 are formed between the wall of the ratchet seat 4 and the arc-shaped barrier strips 44. The first pawl 7 and the second pawl 5 are oppositely mounted on the installation seats 41, and the ratchet teeth structure 72 on the end is exposed outside the arc-shaped barrier strips 44. A reversing cover 2 is clamped outside the ratchet seat 4, and an inner bottom surface of the reversing cover 2 is provided with a paddle 22 located between the end of the first pawl 7 and the end of the second pawl 5. The reversing cover 2 rotates to enable the paddle 22 to act on the end of the first pawl 7 or the end of the second pawl 5, so that the end of the first pawl 7 or the end of the second pawl 5 is engaged with the teeth 31 of the ratchet head 3.

The other end of the first pawl 7 is provided with a protrusion 73 for connecting a spring 10, one end of the spring 10 is connected with the protrusion 73, and the other end of the spring 10 abuts against the cutoff 43 of the annular groove 42. The spring 10 is provided, so that after the paddle 22 is moved away, the first pawl 7 or the second pawl 5 can be returned to an original position to achieve the engagement with the ratchet head 3.

The outer side surface of each arc-shaped barrier strip 44 is adaptive to the inner side surface of the first pawl 7, and the inner side surface of the first pawl 7 fits the outer side surface of each arc-shaped barrier strip 44. A step-shaped holder is arranged in each installation seat 41. The other end of the first pawl 7 is of a corresponding stepped shape, and the first pawl 7 can move in the installation seats 41 in a manner of fitting the arc-shaped barrier strips 44. The overall structure of the installation seats 41, that is, the structure of the outer wall of the arc-shaped barrier strips 44 and the structure of the inner wall of the ratchet seat 4, is used to fit the structure of the first pawl 7 or the structure of the second pawl 5, and also used to limit a movement route of the first pawl 7 or the second pawl 5. The stepped holder is arranged in the installation seats 41, and the other end of the first pawl 7 is of the corresponding stepped shape, so that the movement of the first pawl 7 is smoother.

A protruded seat 45 is also arranged on the other end of the annular groove 42, that is, between the two installation seats 41, and the protruded seat 45 limits the position of the first pawl 7 or the second pawl 5. The paddle 22 is located above the protruded seat 45 and can rotate. The protruded seat 45 can also play a role in supporting the paddle 22. The paddle 22 slides on the upper surface of the protruded seat 45.

The inner wall of the reversing cover 2 is provided with a plurality of grooves 21, and the grooves 21 are located opposite to the paddle 22. The ratchet seat 4 is connected with a latching element 13 through an elastic element 12, and the latching element 13 acts on one of the grooves 21. The reversing cover 2 rotates, so that the latching element 13 shifts among the plurality of grooves 21. Three grooves 21 are provided in the present invention, and the latching element 13 acts on the grooves 21 on two sides to respectively realize the clockwise non-rotation and counterclockwise non-rotation of the ratchet head 3. The latching element 13 acts on the middle groove 21, so that the first pawl 7 and the second pawl 5 are not engaged with the ratchet head 3 at this time, and the ratchet head 3 can rotate in two directions.

The outer surface of the ratchet seat 4 is provided with a recess, the latching element 13 is mounted in the recess through the elastic element 12, and the latching element 13 is a steel ball. The recess and the steel ball structure are arranged to realize the rotation of a reversing ring under the effect of an external force and the immobilization of the reversing ring without the external force.

The head part of the handle 1 is provided with a notch 11, the outer wall of the ratchet seat 4 is provided with a raised strip 48, the notch 11 is adaptive to the outer surface structure of the ratchet seat 4, and the ratchet seat 4 is inserted into the notch 11 and fixed in a circumferential and radial direction. The ratchet seat 4 is independently arranged to facilitate the production of components, and the notch 11 is arranged to realize the axial mounting of the ratchet seat 4, so that the ratchet seat is fixed in a circumferential and radial direction, and the structure of the present invention is reliable when the bolt is screwed.

A first fastener 8 connected with the periphery of the ratchet head 3 in a clamped way is mounted in the notch 11, and a ratchet cover is provided with a second fastener 9 connected with the periphery of the ratchet head 3 in a clamped way. The ratchet head 3 is mounted through the first fastener 8 and the second fastener 9, so that the ratchet head 3 can rotate along the axis.

The head part of the handle 1 is linked to the reversing cover 2, the handle 1 and the reversing cover 2 are in contact connection with each other, and the ratchet head 3 passes through an annular cover and inserted into the ratchet seat 4. The overall appearance of the present invention is simple and elegant, and the reversing cover 2 is convenient to rotate and is not limited by the ratchet head 3 or the handle 1.

The present invention is described above in detail. The principles and the embodiments of the present invention have been described herein with reference to specific examples, and the description of the above embodiments is only to assist in understanding the present invention and its core idea. It should be noted that a person of ordinary skill in the art can make various improvements and modifications to the present invention without departing from the principles of the present invention, and these improvements and modifications also fall within the protection scope of the claims of the present invention.

What is claimed is:

1. An external tooth type ratchet screwdriver, comprising a handle and a ratchet head acting on a bolt, wherein the handle is provided with a ratchet seat, a first pawl and a second pawl; the ratchet head is of a round-bar shape and passes through a center of the ratchet seat; a middle part of an outer surface of the ratchet head is provided with a circle of teeth; the first pawl is of an arc strip-shaped structure, and one end of an inner circle of the first pawl is provided with a ratchet teeth structure; the second pawl has a same structure with the first pawl; an end surface of the ratchet seat is eccentrically provided with a circle of annular groove, and one end of the annular groove is cut off, and arc-shaped barrier strips are oppositely arranged on a cutoff; installation seats are formed between a wall of the ratchet seat and the arc-shaped barrier strips; the first pawl and the second pawl are oppositely mounted on the installation seat, and the ratchet teeth structure on the end is exposed outside the arc-shaped barrier strips; a reversing cover is clamped outside the ratchet seat, and an inner bottom surface of the reversing cover is provided with a paddle located between an end of the first pawl and an end of the second pawl; and the reversing cover rotates to enable the paddle to act on the end of the first pawl or the end of the second pawl, so that the end of the first pawl or the end of the second pawl is engaged with the teeth of the ratchet head;

wherein an outer side surface of each arc-shaped barrier strip is adaptive to an inner side surface structure of the first pawl, and the inner side surface of the first pawl fits the outer side surface of each arc-shaped barrier strip; a step-shaped holder is arranged in the installation seat and the other end of the first pawl is of a corresponding stepped shape, and the first pawl is movable in the installation seat in a manner of fitting each arc-shaped barrier strip.

2. The external tooth type ratchet screwdriver according to claim 1, wherein another end of the first pawl is provided with a protrusion for connecting a spring, one end of the spring is connected with the protrusion, and the other end of the spring abuts against the cutoff of the annular groove.

3. The external tooth type ratchet screwdriver according to claim 1, wherein a protruded seat is further arranged on the other end of the annular groove, that is, between two installation seats; the protruded seat limits a position of the first pawl or the second pawl; and the paddle is located above the protruded seat and is rotatable.

4. The external tooth type ratchet screwdriver according to claim 1, wherein an inner wall of the reversing cover is provided with a plurality of grooves, and the grooves are located opposite to the paddle; the ratchet seat is connected with a latching element through an elastic element, and the latching element acts on one of the grooves; and the reversing cover rotates, so that the latching element shifts among the plurality of grooves.

5. The external tooth type ratchet screwdriver according to claim 4, wherein the outer surface of the ratchet seat is provided with a recess, the latching element is mounted in the recess through the elastic element, and the latching element is a steel ball.

6. The external tooth type ratchet screwdriver according to claim 1, wherein a head part of the handle is provided with a notch; an outer wall of the ratchet seat is provided with a raised strip; the notch is adaptive to an outer surface structure of the ratchet seat; and the ratchet seat is inserted into the notch and fixed in a circumferential and radial direction.

7. The external tooth type ratchet screwdriver according to claim 6, wherein a first fastener connected with a periphery of the ratchet head in a clamped way is mounted in the notch, and the ratchet cover is provided with a second fastener connected with a periphery of the ratchet head in a clamped way.

8. The external tooth type ratchet screwdriver according to claim 1, wherein a head part of the handle is linked to the reversing cover, the handle and the reversing cover are in contact connection with each other, and the ratchet head passes through an annular cover and inserted into the ratchet seat.

* * * * *